US006736296B2

(12) United States Patent
Marino et al.

(10) Patent No.: US 6,736,296 B2
(45) Date of Patent: May 18, 2004

(54) CONTAINER FOR CARRYING LOOSE PRODUCTS

(75) Inventors: Cesare Marino, Legnano (IT); Giuseppe Revello, Bra (IT)

(73) Assignee: Cobra Containers S.p.A., Cuneo (IT)

( * ) Notice: Subject to any disclaimer, the term of this patent is extended or adjusted under 35 U.S.C. 154(b) by 0 days.

(21) Appl. No.: 10/413,512

(22) Filed: Apr. 15, 2003

(65) Prior Publication Data

US 2003/0197039 A1 Oct. 23, 2003

(30) Foreign Application Priority Data

Apr. 17, 2002 (IT) ..... TO2002A0333

(51) Int. Cl.[7] ..... B67D 3/00

(52) U.S. Cl. ..... 222/528; 222/529; 222/530; 222/535

(58) Field of Search ..... 222/105, 527–530, 222/534, 535

(56) References Cited

U.S. PATENT DOCUMENTS 185,249 A * 12/1876 Marshall ..... 222/529
2,899,109 A * 8/1959 Shorkey ..... 222/528
3,211,350 A * 10/1965 Brown ..... 222/538
3,386,605 A 6/1968 Lafont
3,580,434 A 5/1971 Spitzer
5,115,943 A * 5/1992 Coleman ..... 222/105
5,823,404 A * 10/1998 Ronchail ..... 222/535

FOREIGN PATENT DOCUMENTS

| | | | |
|---|---|---|---|
| DE | 2012071 | A | 9/1971 |
| DE | 2915279 | A | 10/1980 |
| FR | 2602494 | A | 2/1988 |
| WO | WO 8909859 | A | 10/1989 |
| WO | WO 9501925 | A | 1/1995 |
| WO | 238472 | A | 5/2002 |

* cited by examiner

*Primary Examiner*—Kenneth Bomberg
(74) *Attorney, Agent, or Firm*—Sughrue Mion, PLLC

(57) ABSTRACT

A container for carrying loose products, the body of which, without inner protective liner, is made of stainless steel. For unloading loose products there is provided at least one elongated dorsal opening, which is equipped with an openable door and to which there is applied a conveyor consisting of a flexible element generally shaped like a funnel, which can be configured in a condition packed inside the opening in the position of closing of the door, and in a distended condition outside the body of the container in the position of opening of the door.

4 Claims, 3 Drawing Sheets

FIG. 3
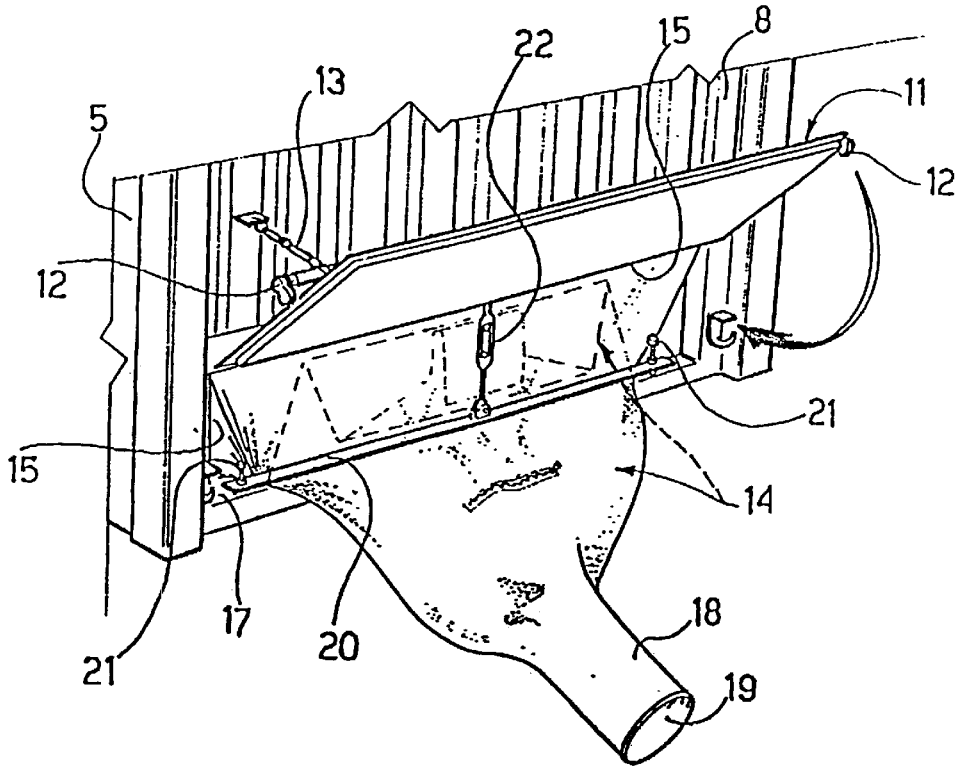
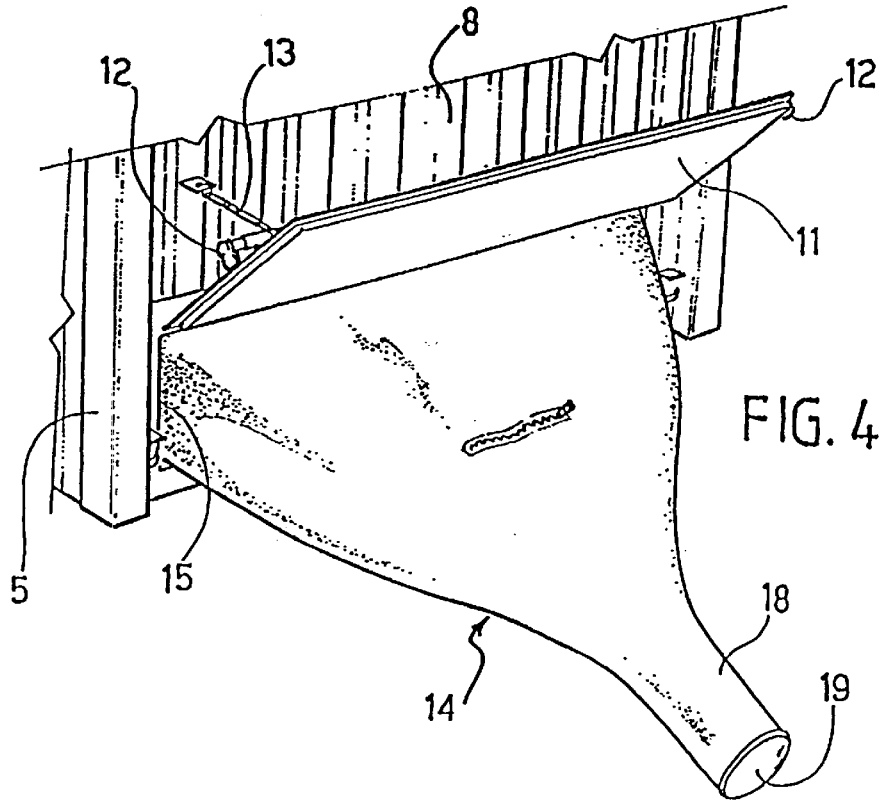
FIG. 4

CONTAINER FOR CARRYING LOOSE PRODUCTS

FIELD OF THE INVENTION

The present invention relates to containers for carrying loose or bulk products of the type comprising a generally parallelepipedal body having at least one closable opening for introduction of loose or bulk products inside it, and an end wall equipped, at the bottom, with means for unloading the loose products.

STATE OF THE PRIOR ART

The body of such containers is traditionally made of metal, generally steel. In order to prevent the loose products introduced into the container from being contaminated by possible contaminating agents, known containers of this type are normally provided, on the inside, with a protective bag, referred to as "liner", which is usually made of plastic material to prevent direct contact between the loose products and the internal walls of the body of the container. The protective liner is for the most part formed at the bottom with a tubular appendage, which can be used for outlet of the loose products through a circular opening for discharge.

The above solution is relatively complicated and costly both on account of the presence of the protective liner and as regards disposal of the protective liner itself, which must be removed and replaced whenever the container is used for carrying products that are different. Furthermore, the conformation of the liner reduces the useful space available inside the container.

According to a further known solution, the body of the container is made of aluminium, which avoids the need for recourse to the internal protective liner, and the discharging means consist, also in this case, of a circular outlet to which there is associated a shut-off valve having a complementary shape. The latter solution is, however, costly if the expenses of fabrication and possible repair connected to the use of aluminium are taken into account.

A further drawback which regards the above known solution lies in the fact that the discharge of loose products through the shut-off valve is relatively slow owing to the modest cross section of the outlet, whereas, instead, a high speed of discharge would be desirable.

SUMMARY OF THE INVENTION

The object of the present invention is to overcome the aforesaid drawbacks.

According to the invention, the above purpose is achieved essentially thanks to the fact that a container for carrying loose products of the type defined at the beginning of this description is characterized in that the body is made of stainless steel and said discharging means include:

- at least one generally elongated opening;
- a door which can be displaced between a closed position and an open position of said elongated opening; and
- a conveyor made up of a flexible element generally shaped like a funnel with a widened end fixed at the edge of said elongated opening, and a restricted free end, said conveyor being able to assume a configuration in a generally packed condition within said elongated opening in the position of closing of said door, and a configuration in a distended condition outside the body in the position of opening of said door.

Thanks to the above idea of solution, the same advantage is achieved as that of containers with a body made of aluminium, i.e., the elimination of the protective liner, which is, instead, used in traditional containers made of steel, with further advantages both in terms of simplification of construction and in terms of greater speed in discharging the loose products from the container.

According to a preferred embodiment of the invention, the aforesaid elongated opening extends substantially throughout the width of the end wall of the body of the container. Alternatively, there may be provided more than one elongated opening, and in this case the container may be divided internally into different sections designed to contain different products, each of which can be discharged separately through a respective elongated opening.

According to a further advantageous characteristic of the invention, the container may moreover comprise closing means for fastening in a removable way the aforesaid flexible conveyor in an area near to said widened end.

BRIEF DESCRIPTION OF THE DRAWINGS

The invention will now be described in detail with reference to the attached drawings, provided merely by way of non-limiting example, in which:

FIGS. 3 and 4 are two perspective views illustrating the modalities of operation of the area of discharge of the container in two subsequent operating conditions.

DETAILED DESCRIPTION OF THE INVENTION

Figure 1:
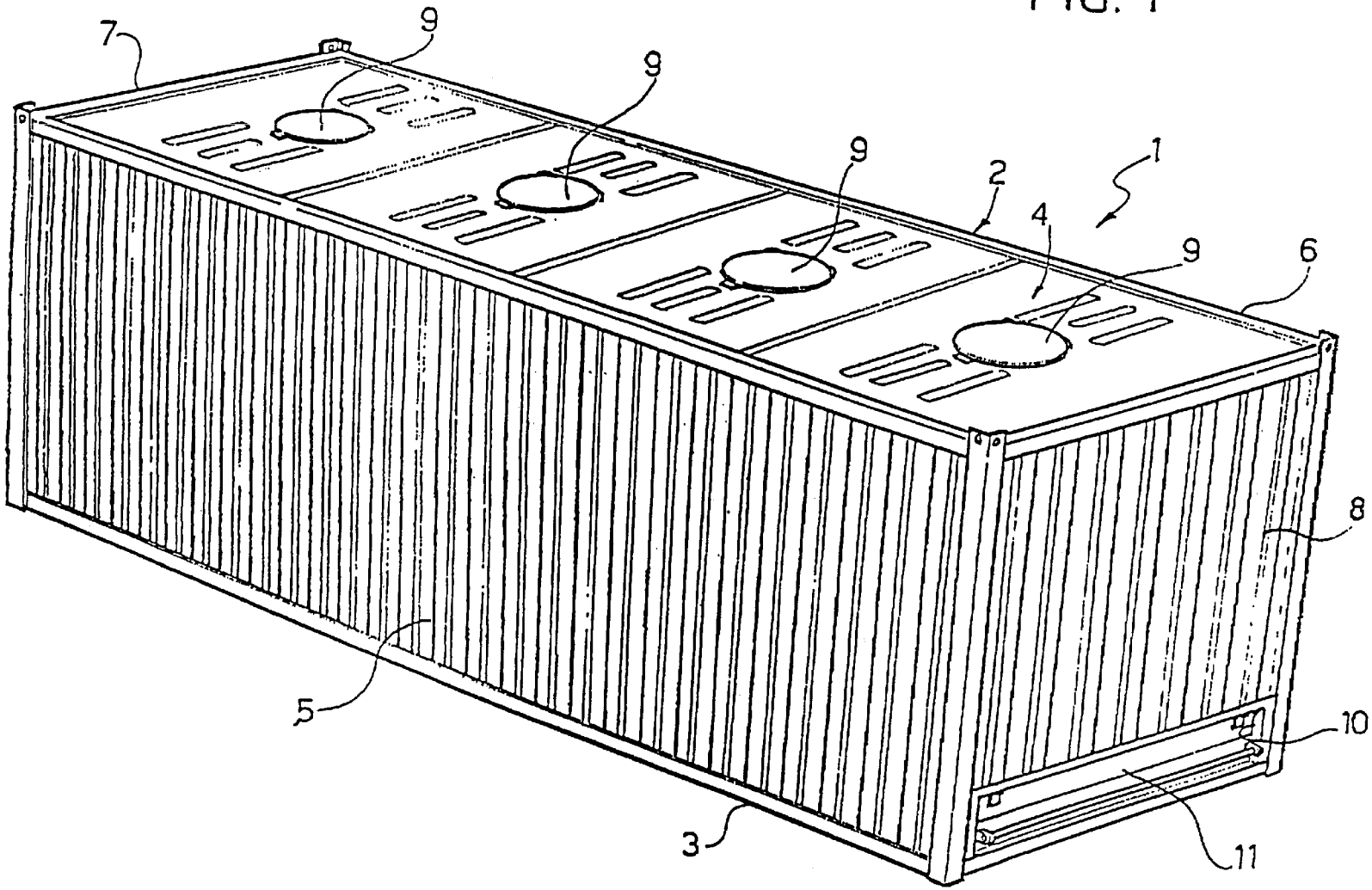
FIG. 1 is a schematic perspective view of a container for carrying loose products according to the present invention.

With initial reference to FIG. 1, number 1 designates as a whole a container according to the invention for carrying loose products.

The container 1 consists of a body 2 of a generally parallelepipedal shape having a bottom wall 3, a top wall 4, side walls 5, 6, a front wall 7, an a dorsal wall 8.

According to a first aspect of the invention, the walls 2–8 are made of stainless steel. This fact makes it possible to prevent any risk of contamination by oxidation of the loose products introduced during use into the container, without any need to equip the container 1 with an internal protective liner. In fact, the container 1 according to the invention is not provided with such a liner.

For introducing loose products into the container, the body 2 of the container is equipped with a set of circular openings, with corresponding openable lids 9 for closing them, in positions corresponding to the top wall 4 of the container.

Figure 2:
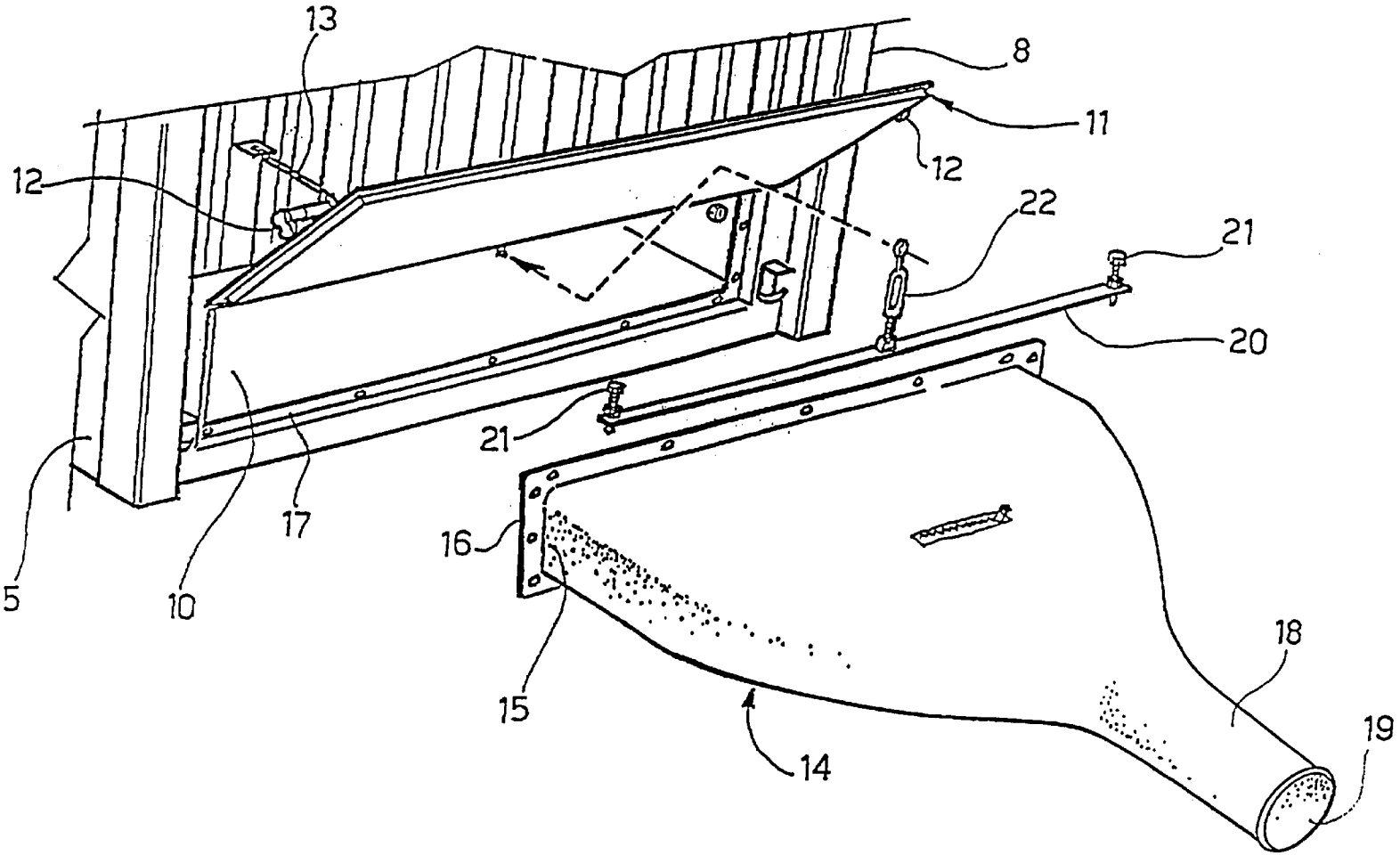
FIG. 2 is an exploded perspective view at a larger scale of the area of discharge of the container.

For discharging loose products following upon transportation to the destination, the container 1 is formed in the lower area of its dorsal wall 8, i.e., in the immediate vicinity of the bottom wall 3, with an elongated outlet 10, to which there is operatively associated a movable closing door 11. In the case of the example illustrated, the door 11 is able to oscillate between the shut position represented in FIG. 1, in which it closes the opening 10 in a substantially hermetic way, and a raised position, represented in FIGS. 2 to 4, for enabling exit of the loose products contained in the container 1 through the opening 10.

The door 11 is hinged, along its top horizontal side, to the dorsal wall 8, immediately above the opening 10, and, in the shut position, it is blocked, for example by means of latches 12, in an area corresponding to the bottom side of the door. In order to keep the door 11 in its raised, open position, for enabling exit of the loose products, there may be provided one or more tie-rods 13.

For exit of the loose products from the container 1, the invention provides an original conveyor consisting of a generally funnel-shaped element 14 made of flexible material, for example, PVC or the like. The conveyor 14 has a widened end 15 joined to a generally rigid flanged frame 10, which is, in turn, fixed in a removable way to enable washing or possible replacement of the conveyor 14, in a position corresponding to an annular surface of attachment 17 surrounding the opening 10. At a certain distance from the widened end 15, the conveyor 14 tapers to form a tubular appendage 18, which terminates at the restricted, free end 19 of said conveyor 14. The end 19 can normally be closed in an openable way, for example by means of a strap or the like (not illustrated).

The reference number 10 designates a closing bar, which is fixed in a removable way, for instance, by means of a pair of adjustable end elements 21, to the bottom side of the opening 10 and has the function of fasten firmly the conveyor 14, in an area near to the widened end 15, in the way shown in FIG. 3. The fastening bar 20 can, moreover, be connected to the upper end of the opening 15 by means of one or more adjustable struts 22.

In use, when the door 11 is closed in the way represented in FIG. 1, so as to obstruct passage through the discharge outlet 10, the conveyor 14 is closed in the way explained previously by the fastening bar 20 and is folded back or else rolled up, or anyway packed, against the inner wall of the door 11, in the way indicated by a dashed line in FIG. 3. In this configuration, the conveyor 14 does not adversely affect the useful space inside the container 1, which can thus be filled entirely with the loose products that are to be transported, the said products being introduced into the container through the top doors 9.

Upon discharge by the force of gravity of the loose products from the container 1, the door 11 is set in the raised opening condition represented in FIG. 3, so as to free the access to the conveyor 14, which can thus be distended in the way represented in the same Figure and possibly coupled to a distributing device.

Then the fastening bar 20 is removed, in the way represented in FIG. 4, so as to enable the loose products to come out through the opening 10 towards the restricted end 19 of the conveyor 14, and then outside the container 1.

At the end of discharge, the packed condition of the conveyor 14 is restored, after application of the fastening bar 20, and the door 11 is brought into the shut closing position.

Of course, the details of construction and the embodiments may vary widely with respect to what is described and illustrated herein, without thereby departing from the scope of the present invention as defined in the ensuing claims.

Thus, for example, instead of a single opening 10, two or more distinct discharge openings could be provided, set alongside one another and each communicating with a respective space inside the container 1 separated from other internal spaces via longitudinal dividing walls. In the above case, the container 1 may be used for carrying different loose products, which can be discharged separately by means of respective conveyors, similar to the conveyor 14, which are applied to the various discharge openings.

What is claimed is:

1. A container for carrying loose products, comprising a generally parallelepipedal body having at least one closable opening for introduction of loose products therein and an end wall having a bottom provided with discharging means for discharging loose products, said body being made of stainless steel without a liner and said discharging means including:

at least one generally elongated opening;

a door which can be displaced between a closed position and an open position of said elongated opening; and a conveyor made up of a flexible element generally shaped like a funnel with a widened end fixed at the edge of said elongated opening and a restricted, free end, said conveyor being designed to assume a configuration in a generally packed condition within said elongated opening in the closed position of closing of said door, and a configuration in a distended condition outside said body of said container in the open position of said door.

2. The container according to claim 1, wherein said elongated opening extends substantially throughout the width of said end wall.

3. The container according to claim 1, further comprising closing means for fastening, in a removable way, said conveyor in an area close to said widened end.

4. The container according claim 1, wherein said conveyor is fixed at the edge of said elongated opening in a removable way.

* * * * *